United States Patent [19]

Iida et al.

[11] Patent Number: 5,028,222

[45] Date of Patent: Jul. 2, 1991

[54] FLUID COMPRESSOR WITH AXIAL THRUST BALANCING

[75] Inventors: Toshikatsu Iida; Yoshinori Sone, both of Yokohama, Japan

[73] Assignee: Kabushiki Kaisha Toshiba, Kawasaki, Japan

[21] Appl. No.: 450,066

[22] Filed: Dec. 13, 1989

[30] Foreign Application Priority Data

Dec. 28, 1988 [JP] Japan ..... 63-333584

[51] Int. Cl.[5] ..... F04B 39/02

[52] U.S. Cl. ..... 418/220

[58] Field of Search ..... 418/220, 181, 203; 915/104, 105, 107

[56] References Cited

U.S. PATENT DOCUMENTS

| | | | |
|---|---|---|---|
| 1,698,802 | 1/1929 | Montelius | 418/203 |
| 2,095,167 | 10/1937 | Burghauser | 418/203 |
| 2,111,883 | 3/1938 | Burghauser | 418/203 |
| 2,401,189 | 5/1946 | Quiroz . | |
| 2,527,536 | 10/1950 | Engberg . | |
| 4,462,769 | 7/1984 | Schibbye . | |
| 4,875,842 | 10/1989 | Iida et al. | 418/220 |

*Primary Examiner*—Leonard E. Smith
*Assistant Examiner*—David L. Cavanaugh
*Attorney, Agent, or Firm*—Cushman, Darby & Cushman

[57] ABSTRACT

A compressor includes a casing wherein a compression section and a drive section are contained. The compression section has a cylinder, a rotary rod eccentrically arranged in the cylinder and rotatable relative to the cylinder, and first and second bearings rotatably supporting suction- and discharge-side ends of the cylinder. A space defined between the inner circumferential surface of the cylinder and the outer circumferential surface of the rod is divided into a plurality of operating chambers by a spiral blade mounted on the rod. A fluid introduced into the suction-side end of the cylinder is transferred to the discharge-side end of the cylinder through the operating chamber while it is compressed. The compressed fluid is discharged into the casing. The pressure of the introduced fluid is applied to a discharge-side end of the rod, and the pressure of the compressed fluid is applied to a suction-side end of the rod.

12 Claims, 4 Drawing Sheets

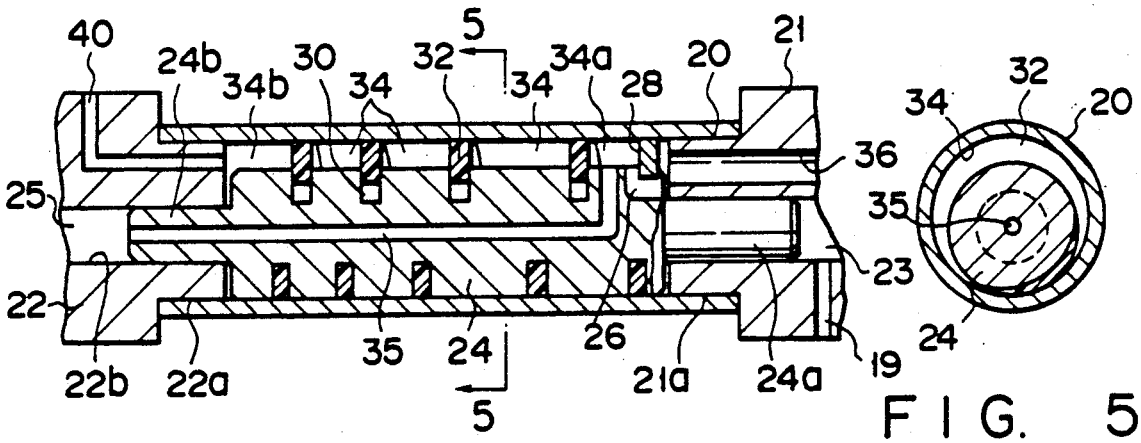
FIG. 5
FIG. 4
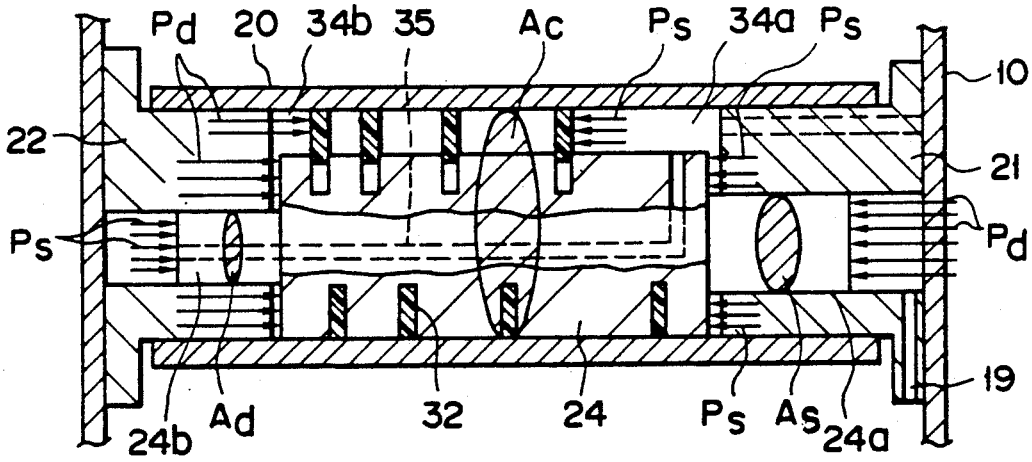
FIG. 8

FLUID COMPRESSOR WITH AXIAL THRUST BALANCING

BACKGROUND OF THE INVENTION

1. Field of the Invention

This invention relates to a fluid compressor for compressing a fluid, for example, refrigerant gas in a refrigerating cycle.

2. Description of the Related Art

Conventionally known are various compressors, including reciprocating compressors, rotary compressors, etc. In these conventional compressors, the compression section and drive parts, such as a crank shaft for transmitting a rotational force to the compression section, are complicated in construction, i.e., with many components being used in their construction. For higher compression efficiency, moreover, these conventional compressors should be provided with a check valve on the discharge side thereof. However, the pressure difference between two opposite sides of the check valve is so large that gas is likely to leak from the valve. Thus, the compression efficiency cannot be high enough. For solving these problems, the individual parts must be manufactured and assembled at high accuracies, resulting in a high manufacturing cost.

U.S. Pat. No. 2,401,189 and U.S. Pat. No. 2,527,536 disclose screw pumps each provided with a columnar rotary body having a suction end and a discharge end. The rotary body is arranged in a sleeve and has a spiral groove on its outer periphery. A spiral blade is slidably fitted in the groove. As the rotary body is rotated, a fluid, confined between two adjacent turns of the blade in the space between the outer peripheral surface of the rotary body and the inner peripheral face of the sleeve, is transported from one end of the sleeve to the other.

With the pumps described above, thrust exerted on the rotary body during operation increases friction between the rotary body and bearings, thereby deteriorating the efficiency of the pumps. In the pump disclosed in U.S. Pat. No. 2,527,536, two rotors are arranged opposed to each other so as to balance the thrust exerted on the rotary body. However, this pump still consists of many parts and has a complicated structure.

Accordingly, the conventional compressors have a problem that they must be provided with many parts and have a complicated structure so as to prevent the generation of thrust exerting on the rotary body.

SUMMARY OF THE INVENTION

The object of this invention is to provide a fluid compressor which has a simple construction for preventing the generation of thrust exerting on a rotary body and has high compression efficiency.

In order to achieve this object, a fluid compressor according to this invention comprises:

a cylinder having a suction-side end and a discharge side-end;

first bearing means for rotatably supporting and air-tightly closing the suction-side end of the cylinder;

second bearing means for rotatably supporting and air-tightly closing the discharge-side end of the cylinder;

a columnar rotary body located in the cylinder so as to extend in an axial direction of the cylinder and be eccentric thereto, and rotatable relative to the cylinder in such a manner that part of the rotary body is in contact with the inner circumferential surface of the cylinder, the rotary body having a suction-side end rotatably supported by the first bearing means, a discharge-side end rotatably supported by the second bearing means, and a spiral groove formed on the outer circumferential surface of the rotary body, the spiral groove having pitches being narrowed gradually with distance from the suction-side end of the cylinder;

a spiral blade fitted in the groove so as to be slidable, substantially in the radial direction of the cylinder, having an outer peripheral surface in close contact with the inner circumferential surface of the cylinder, and dividing a space defined between the inner circumferential surface and the outer circumferential surface of the rotary body into a plurality of operating chambers;

drive means for relatively rotating the cylinder and the rotary body, thereby introducing a fluid from the suction-side end of the cylinder into the operating chamber at the side of the suction-side end of the rotary body, transporting the fluid toward the discharge-side end of the cylinder through the operating chambers, and discharging the fluid from the discharge-side end of the cylinder to the outside;

first pressure applying means for applying pressure higher than pressure of the fluid introduced into the suction-side end of the cylinder to the suction-side end of the rotary body; and second pressure applying means for applying pressure lower than pressure of the fluid discharged from the discharge-side end of the cylinder to the discharge-side end of the rotary body.

With this compressor according to this invention, thrust exerting on the rotary body and friction are reduced by a simple construction.

BRIEF DESCRIPTION OF THE DRAWINGS

FIGS. 1 to 8 show a fluid compressor according to an embodiment of the present invention, in which:

FIG. 1 is a longitudinal sectional view of the fluid compressor in which only the blade and the rod are depicted in a side view for ease of understanding;

FIG. 2 is a side view of a rotary body of the fluid compressor;

FIG. 3 is a side view of a blade fitted in the rotary body;

FIG. 4 is a longitudinal sectional view of the compression section of the compressor;

FIG. 5 is a cross sectional view taken along line V—V in FIG. 4;

FIG. 8 is a schematical view illustrating how pressure is applied to each part of the compression section; and FIGS. 9 and 10 show a fluid compressor according to another embodiment of the present invention, in which:

FIG. 9 is a longitudinal sectional view of the fluid compressor, in which only the blade and the rod are depicted in a side view for ease of understanding; and FIG. 10 is an exploded perspective view of a bearing supporting mechanism of the compressor.

DETAILED DESCRIPTION OF THE PREFERRED EMBODIMENTS

Embodiments of this invention, will now be described in detail with reference to the accompanying drawings.

Figure 1:
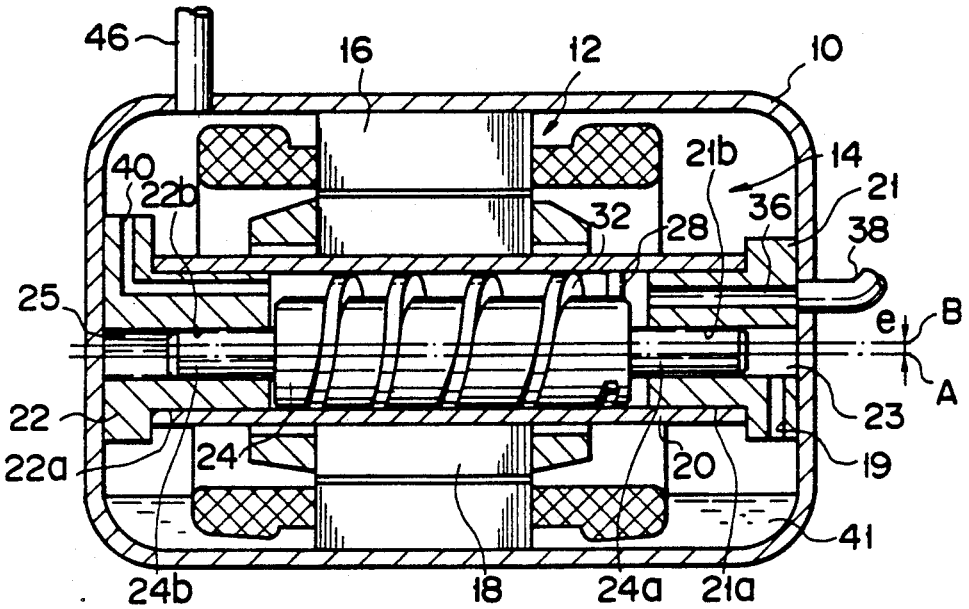

FIG. 1 shows a closed type compressor for compressing refrigerant gas in a refrigerating cycle, to which this invention is applied.

The compressor includes a closed casing 10, and an electric drive section 12 and a compression section 14 which are housed in the casing 10. The drive section 12 has an annular stator 16 fixed to the inner peripheral face of the casing 10, and an annular rotor 18 located inside the stator 16.

As shown in FIGS. 1 and 4, the compression section 14 has a cylinder 20, to the outer peripheral surface of which the rotor is coaxially fixed. Both ends of the cylinder 20 are closed and rotatably supported by bearings 21 and 22 which are fixed to the inner face of the casing 10. Specifically, the right end portion of the cylinder 20 (i.e., a suction-side end) is rotatably fitted on a peripheral portion 21*a* of the bearing 21, and the left end portion of the cylinder 20 (i.e., a discharge-side end) is rotatably fitted on a peripheral portion 22*a* of the bearing 22. In this way, the cylinder 20 and the rotor 18 fixed thereto are supported by the bearings 21 and 22 in a coaxial relation with the stator 16.

Within the cylinder 20, a columnar rotary rod 24 having its diameter smaller than the inner diameter of the cylinder 20 extends along the axial of the cylinder 20. The central axis A of the rod 24 is situated at eccentricity e from the central axis B of the cylinder 20. Part of the outer circumferential surface of the rod 14 is in contact with the inner circumferential face of the cylinder 20.

Figure 2:
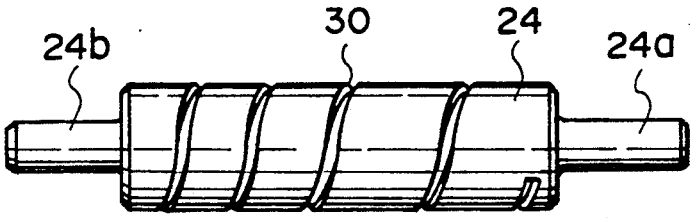

Referring to FIG. 2, the rotary rod 24 is formed with integral columnar sliding portions 24*a* and 24*b* which project from the suction-side and the discharge-side ends of the rotary rod. The sliding portions 24*a* and 24*b* have an outer diameter smaller than that of the rod proper and are coaxial therewith. The sliding portion 24*a* is rotatably inserted in a bearing hole 21*b* penetrating the bearing 21. Likewise, the sliding portion 24*b* is rotatably inserted in a bearing hole 22*b* penetrating the bearing 22. The bearing holes 21*b* and 22*b* are arranged coaxially with each other and are eccentric by the distance e with respect to the cylinder 20, so that the rod 24 is rotatably supported by the bearings 21 and 22 in a predetermined position with respect to the cylinder 20. The end faces of the rod proper of the rod 24 are separated by a predetermined distance from the facing end faces of the bearings 21 and 22.

Within the bearing hole 21*b*, a first closed space 23 is defined between the inner face of the casing 10 and the free end face of the sliding portion 24*a*. The space 23 communicates with the interior of the casing 10 through a discharge-pressure introducing passage 19 formed in the bearing 21. The passage 19 and the first closed space 23 constitute a later described first pressure-applying means. Within the bearing hole 22*a*, a second closed space 25 is defined by the inner face of the casing 10 and the end face of the sliding portion 24*b*.

As shown in FIG. 8, the sum of the cross-sectional areas As and Ad of the sliding portions 24*a* and 24*b* is substantially equal to the cross-sectional area Ac of the inner hole of the cylinder 20. In other words, there is a relation $$AC = As + Ad$$

between the cross-sectional area Ac of the inner hole of the cylinder 20, the cross-sectional area As of the suction-side end 24*a* and the cross-sectional area Ad of the discharge-side end 24*b*.

Referring to FIGS. 1 and 4, an engaging groove 26 is formed on the outer peripheral surface of the suction-side end portion of the rotary rod 24. A drive pin 28 projects from the inner peripheral face of the cylinder 20 and is inserted into the engaging groove 26 to be slidable in the radial direction of the cylinder 20. When the cylinder 20 is rotated together with the rotor 18 by energizing the drive section 12, the rotational force of the cylinder 20 is transmitted to the rotary rod 24 through the drive pin 28. As a result, the rotary rod 24 rotates within the cylinder 20 while part of the outer circumferential surface thereof is in contact with the inner circumferential surface of the cylinder 20.

Figure 3:
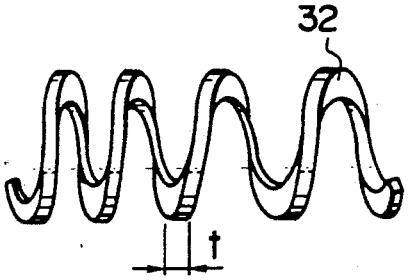
Figure 6A:
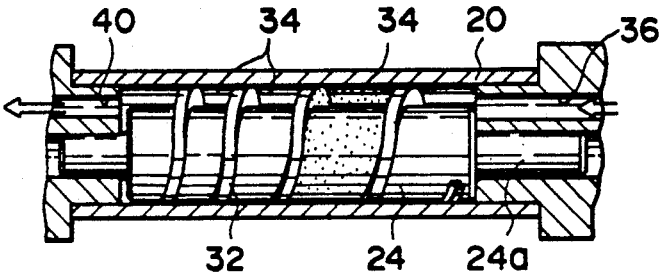
FIGS. 6A to 6D show the processes compressing refrigerant gas of the fluid compressor.

As seen from FIGS. 1 and 2, a spiral groove 30 is formed in the outer circumferential surface of the rotary rod 24 and extends between the two opposite ends of the rod proper 24. As best shown in FIG. 2, the pitches of the groove 30 gradually become narrower with distance from the right end or the suction side end of the cylinder 20. A spiral blade 32 shown in FIG. 3 is fitted in the groove 30. The thickness t of the blade 32 substantially coincides with the width of the groove 30, and each portion of the blade is movable in the radial direction of the rotary rod 24 along the groove 30. The outer circumferential surface of the blade 32 slides on the inner circumferential face of the cylinder 20 intimately in contact therewith. The blade 32 is made of an elastic material such as Teflon (Trademark) and is fitted into the groove 30 by utilizing its elasticity.

As seen from FIGS. 1 and 4, the space defined between the inner circumferential face of the cylinder 20 and the outer circumferential surface of the rod 24 is divided by the blade 32 into a plurality of operating chambers 34. Each operating chamber 34, which is defined between two adjacent turns of the blade 32, is substantially in the form of a crescent shape extending along the blade 32 from a contact portion between the rod 24 and the inner circumferential face of the cylinder 20 to the next contact portion, as is shown in FIG. 5. The capacities of the operating chambers 34 are reduced gradually with distance from the suction end side of the cylinder 20.

In the rod 24 is formed a suction-pressure introducing passage 35 extending along the central axis of the rod 24. One end of the passage 35 opens at the end face of the sliding portion 24*b* at the discharge end side to communicate with the second closed space 25. The other end of the passage 35 opens at the outer circumferential surface of the rod 24 at the suction end side thereof to communicate with the operating chamber 34*a* which is located closest to the suction-side end of the cylinder 20. The introducing passage 35 and the second closed space 25 constitute second pressure-applying means. An axially extending suction hole 36 penetrates the bearing 21 which supports the suction-side end of the cylinder 20. One end of the suction hole 36 opens into the suction-side end of the cylinder 20 and the other end thereof is connected to a suction tube 38 of the refrigerating cycle. An axially extending discharge hole 40 is formed in the bearing 22 which support the discharge-side end portion of the cylinder 20. One end of the discharge hole 40 opens into the discharge-side end portion of the cylinder 20, and the other end thereof opens to the interior of the casing 10. Alternatively, the discharge hole 40 may be formed in the cylinder 20. Lubricating oil is stored at the bottom of the casing 10.

In FIG. 1, reference numeral 46 designates a discharge tube communicating with the interior of the casing 10.

The operation of the above-described compressor will be explained.

When the electric drive section 12 is energized, the rotor 18 rotates, so that the cylinder 20 rotates integrally therewith. At the same time, the rotary rod 24 is rotated while its outer circumferential surface is partially in contact with the inner circumferential face of the cylinder 20. The relative rotary motions between the rod 24 and the cylinder 20 is ensured by regulating means which includes the pin 28 and the engaging groove 26. In this case, the blade 32 rotates integrally with the rod 24.

Figure 7A:
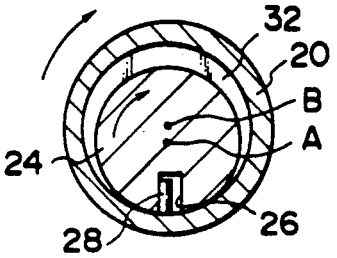
FIGS. 7A to 7D show the relative positions between a cylinder and the rotating body in the respective compressing process.
Figure 6B:
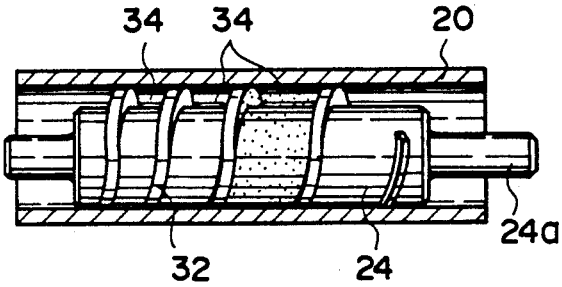
Figure 7B:
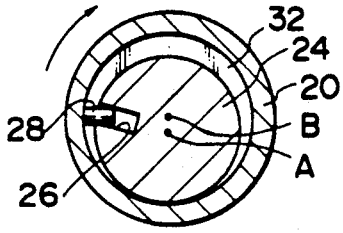
Figure 6C:
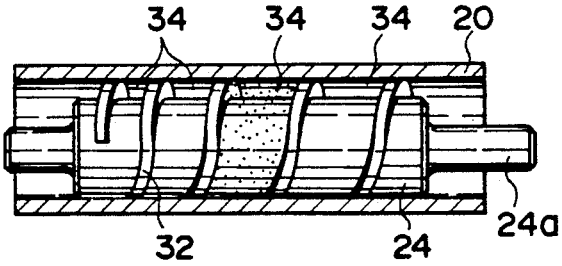
Figure 7C:
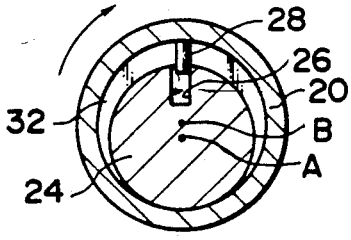
Figure 6D:
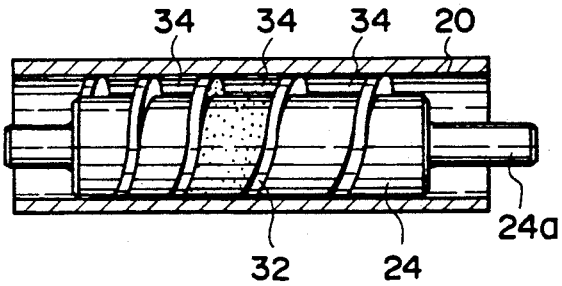
Figure 7D:
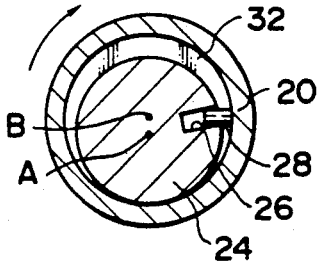

Since the blade 32 rotates while part of the outer circumferential surface thereof is in contact with the inner circumferential face of the cylinder 20, each part of the blade 32 is pushed into the groove 30 as it approaches each contact portion between the inner circumferential surface of the cylinder 20 and the outer circumferential face of the rod 24, and emerges from the groove 30 as it goes away from the contact portion. When the compression section 14 is started, refrigerant gas is sucked into the cylinder 20 via the suction tube 38 and the suction hole 36. First, the gas is confined in the operating chamber **34*a* which is located closest to the suction-side end of the cylinder 20. As the rotary rod 24 rotates, as shown in FIG. 6A to 6D, the gas is successively transferred to the operating chambers 34 arranged downstream side of the operating chamber 34*a* on the discharge-side of the cylinder 20 while the gas is confined in the space defined between the two adjacent turns of the blade 32. Because the capacities of the operating chambers 34 are reduced gradually with distance from the suction-side end of the cylinder 20, the refrigerant gas is gradually compressed as it is delivered to the discharge-side end. The compressed refrigerant gas is discharged from the discharge port 40 formed in the bearing 40 into the casing 10 and is then returned to the refrigerating cycle through the discharge tube 46. During the compression, the relative positions between the cylinder 20 and the rotary rod 24 change, as shown in FIGS. 7A to 7**D.

Referring to FIGS. 4 and 8, during the compression, part of the refrigerant gas sucked into the operating chamber **34*a* flows into the second closed space 25, which is formed in the bearing 22 of the discharge-side end, through the suction-pressure introducing passage 35. Therefore, suction pressure Ps of the refrigerant gas is applied to the end face of the sliding portion 24*a* of the rotary rod 24. According to the extent of the suction pressure, thrust directed from the discharge-side end towards the suction-side end is exerted on the rotary rod 24**.

Part of the pressurized refrigerant gas, which is discharged from the cylinder 20 into the casing 10, flows in the first closed space 23 through the discharge-pressure introducing passage 19 formed in the bearing 21 at the suction-side end, and discharge pressure Pd of the refrigerant gas is applied to the end face of the sliding portion **24*a* of the rotary rod 24. According to the extent of the discharge pressure, thrust directed from the suction-side end towards the discharge-side end is exerted on the rotary rod 24**.

The suction pressure Ps of the refrigerant gas introduced in the operating chamber **34*a* exerts on the suction-side end face of the rotary rod 24 and that portion of the blade 32 which faces the operating chamber 34*a*. In accordance with the suction pressure Ps, thrust directed from the suction-side end towards the discharge-side end of the rod 24 is applied thereto. Further, the discharge pressure Pd of the refrigerant gas, which is pressurized in the cylinder 20, exerts on that portion of the blade 32 which faces the operating chamber 34*b* located closest to the discharge-side end of the cylinder 20 and on the discharge side end face of the rotary rod 24. This discharge pressure Pd produces thrust exerted on the rotary rod 24** in the direction from its discharge-side end to its suction-side end.

Since the sum of the cross-sectional areas of the sliding portions **24*a* and 24*b* of the rotary rod 24 are selected to be equal to the cross-sectional area Ac of the inner space defined by the inner circumferential face of the cylinder 20, the thrusts exerting on the rotary rod 24** from its suction side and from its discharge side are in equilibrium. In other words, the relations between the thrust Ss exerting from the suction side and the thrust Sd exerting from the discharge side are expressed by the following equations:

$$Ss = Ps\cdot(Ac - As) + Pd\cdot As \quad (1)$$

$$Sd = Pd\cdot(Ac - Ad) + Ps\cdot Ad \quad (2)$$

From Equations (1) and (2), the difference between the thrusts Ss and Sd is obtained as follows:

$$Ss - Sd = PsAc - PsAs + PdAs - PdAc + PdAd - PsAd$$

Simplifying this equation, $$Ss - Sd = (Ps - Pd)(Ac - As - Ad) \quad (3)$$

is obtained. As described above, $Ac = As + Ad$ and thus $Ac - As - Ad = 0$. Putting this in Equation (3), $$Ss - Sd = 0,$$

is obtained. It follows that the thrusts Ss and Sd are equal to each other in magnitude and exert on the rotary rod 24 in the directions opposite to each other. Therefore, these thrusts are canceled to each other, the resultant thrust applied to the rotary rod 24 is substantially zero.

With the compressor constructed as described above, the groove 30 formed in the outer circumferential surface of the rotary rod 24 has pitches which gradually become narrower with distance from the suction-side end thereof. Thus, the capacities of the operating chambers 34 divided by the blade 32 are gradually reduced with distance from the suction-side end of the cylinder 20. With this structure, the refrigerant gas can be compressed while it is transferred from the suction-side end of the cylinder 20 to the discharge-side end thereof. Further, since the refrigerant gas is transferred and compressed while it is confined in the operating chambers 34, enabling the gas to be efficiently compressed even though no discharge valve is provided at the discharge side of the compressor.

The omission of the discharge valve simplifies the structure of the compressor and reduces the number of parts. Because the rotor 18 of the electric drive section 12 is supported by the cylinder 20 of the compression section 14, it is unnecessary to provide a special rotary shaft, bearings or the like for supporting the rotor 18. Thus, the structure of the compressor is more simplified and the number of parts are reduced further.

The sum of the cross-sectional areas of the sliding portions 24*a* and 24*b* of the rotary rod 24 is set to be equal to the cross-sectional area of the inner hole of the cylinder 20. The suction pressure of the refrigerant gas is applied to the end face of the discharge side sliding portion 24*b* by means of the suction-pressure applying means, and, at the same time, the discharge pressure of the refrigerant gas is applied to the end face of the suction side sliding portion 24*a* by means of the discharge-pressure applying means. With this structure, the thrusts exerting on the rotary rod 24 from the suction- and discharge-side ends thereof can be in equilibrium, regardless of the level in the suction pressure and the discharge pressure of the refrigerant gas. Thus, the friction between the rotary rod 24 and the bearings 21 and 22 is remarkably reduced, resulting in the improvement of the operational efficiency of the compressor. Further, since it is unnecessary to provide thrust bearings such as ball bearings in the compression section 14, the reduction of the number of parts and the simplification of the structure can be attained.

The cylinder 20 and rotary rod 24 are in contact with each other while they rotate in the same direction. Therefore, the friction between the cylinder and the rotary rod is so small that they can rotate smoothly with less vibration and noises.

The feeding capacity of the compressor depends on the first pitch of the blade 32 i.e., the capacity of the operating chamber 34*a* located closest to the suction-side end of the cylinder 20. With this embodiment, the pitches of the blade 32 gradually become narrower with distance from the suction side of the cylinder 20. If the number of turn of the blade 32 is fixed, therefore, the first pitch of the blade and hence, the feeding capacity of the compressor, according to this embodiment, can be made greater than those of a compressor whose blade has regular pitches throughout the length of the rotary rod. Accordingly, a high-efficiency compressor can be obtained. In other words, the compressor of this embodiment has a higher compressing efficiency. If the number of the turns of the blade 32 is increased, although the feeding capacity of the refrigerant gas is reduced, then the pressure difference between each two adjacent operating chambers decreases in inverse proportion. Thus, the amount of gas leak between the adjacent operating chambers is reduced, thereby improving the compassing efficiency.

This invention is not limited to the above-mentioned embodiment but various modifications are available within the scope of this invention.

For example, even if each part of the compressor is constructed such that the sum of the cross-sectional areas As and Ad is not completely equal to the cross-sectional area Ac of the inner space of the cylinder 20, unbalance of the thrusts can be reduced. Moreover, the pressure applied to the end face of the sliding portion 24*b* of the rod 24 may be higher than the suction pressure Ps, and the pressure applied to the end face of the sliding portion 24*a* may be lower than the discharge pressure Pd.

With the above embodiment, the two bearings are fixed to the inner face of the casing. Alternatively, one of the bearings may be arranged to be movable with respect to the casing.

Figure 9:
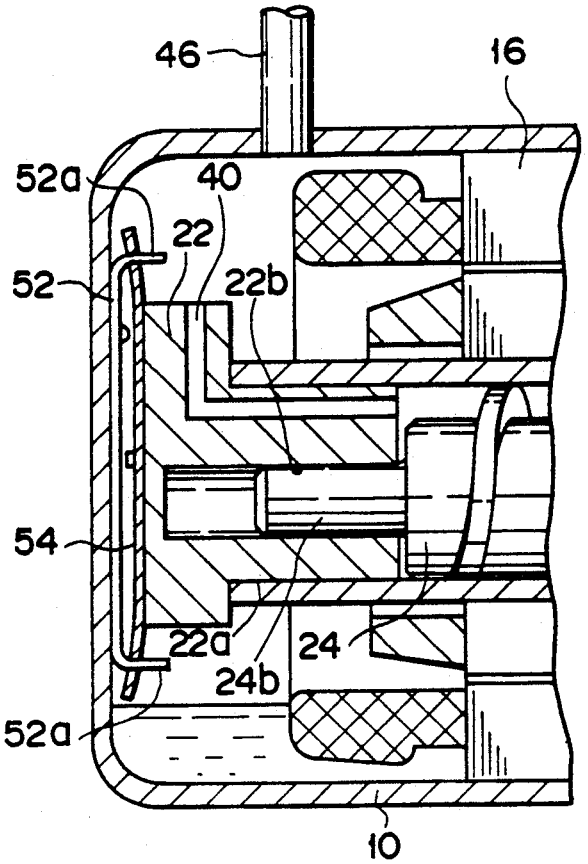
Figure 10:
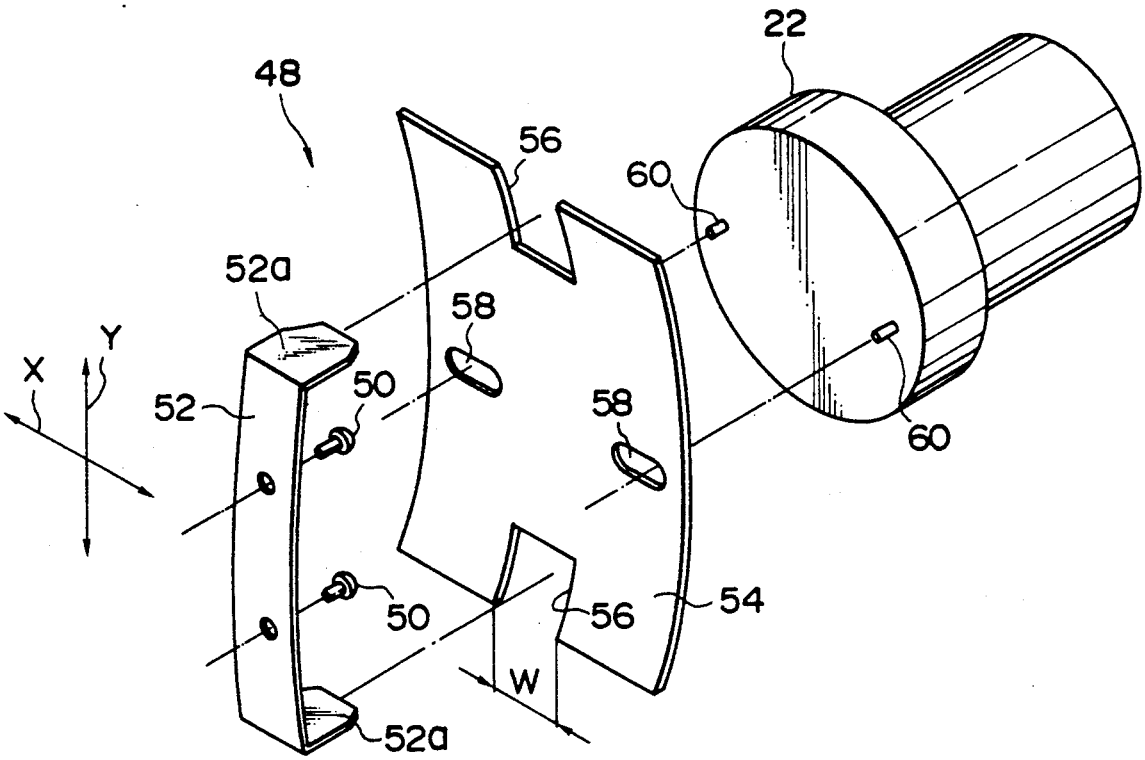

According to a second embodiment of this invention shown in FIGS. 9 and 10, a bearing 22 at the discharge side is supported by a support mechanism 48 on the inner face of the casing 10 so as to be movable radially of a cylinder 20. A bearing hole 22*b* is formed in the bearing 22 and receives the sliding portion 24*b* of the rotary rod 24 therein. The end of the hole 22*b*, located close to the inner face of the casing 10, is closed. The support mechanism 48 comprises an elongate plate-like holding member 52 fixed to the inner face of the casing 10 by pins 50, and a generally rectangular support plate 54. Depressions 56 having a predetermined width w are formed in a pair of opposite side edges of the support plate 54 such that the plate 54 assumes a substantially H shape. The holding member 52 has a width substantially equal to that of the depressions 56. The opposite two end portions of the holding member 52 are bent towards the inside of the casing 10 to form bent portions 52*a*. The bent portions 52*a* are inserted in the depressions 56 such that the support plate 54 is supported by the holding plate 52 irrotationally and movably in the axial direction of the holding member 52 (i.e., in the direction of an arrow Y in FIG. 10). A pair of elongate holes 58 are formed in the support plate 54 and extend in the direction X perpendicular to the moving direction Y of the support plate 54. These holes 58 are aligned in the direction X as shown in FIG. 10. A pair of projections 60 project from the free end face of the bearing 22 and are located on a common a circle which is coaxial with the cylinder 20. The projections 60 are fitted in the elongate holes 54 to be movable in the axial direction of the holes. Thus, the bearing 22 is supported by the support plate 54 so as to be movable in the direction X with respect to the supporting plate 54 but is prevented from rotating with respect thereto by the projections 60. As described above, the support plate 54 is movable in the direction Y. With this structure, therefore, the bearing 22 is movable in both the directions X and Y. In other words, the bearing 22 is supported to be movable in the radial direction of the cylinder 20.

In addition to the advantages of the first embodiment, the second embodiment has the advantages that the movable structure of the bearing 22 enables the bearings 21 and 22 to be easily aligned with each other when the compressor is assembled.

The fluid compressor according to this invention is applicable to not only a refrigerating cycle but also other devices.

What is claimed is:

1. A fluid compressor comprising:

a cylinder having a suction-side end and a discharge-side end;

first bearing means for rotatably supporting and air-tightly closing said suction-side end of the cylinder;

second bearing means for rotatably supporting and air-tightly closing said discharge-side end of the cylinder;

a casing containing said cylinder and first and second bearing means therein;

a columnar rotary body arranged in the cylinder so as to extend in an axial direction of the cylinder and be eccentric thereto, and rotatable relative to said cylinder in such a manner that part of the rotary body is in contact with the inner circumferential face of the cylinder, said rotary body having a suction-side end rotatably supported by the first bearing means, a discharge-side end rotatably supported by the second bearing means, and a spiral groove formed in the outer circumferential surface of the rotary body, the spiral groove having pitches being narrowed gradually with distance from said suction-side end of the cylinder;

a spiral blade fitted in the spiral groove so as to be slidable, substantially in the radial direction of said cylinder, having an outer circumferential surface in close contact with the inner circumferential face of the cylinder, and dividing a space defined between the inner circumferential face and the outer circumferential surface of the rotary body into a plurality of operating chambers;

drive means for relatively rotating the cylinder and the rotary body, thereby introducing a fluid from the suction-side end of said cylinder into the operating chamber at the side of the suction-side end of the rotary body, transferring the fluid toward the discharge-side end of the cylinder through the operating chambers, and discharging the fluid from the discharging-side end of the cylinder into the casing;

first pressure applying means for applying pressure of the fluid discharged into the casing to the suction-side end of the rotary body, said first pressure applying means including a first closed space defined in said first bearing means and facing the suction-side end of the rotary body, and a first introducing passage formed in the first bearing means to introduce the fluid within the casing into the first closed space; and second pressure applying means for applying pressure of the fluid introduced into the cylinder to the discharge-end side of the rotary body, said second pressure applying means including a second closed space defined in the second bearing means and facing the discharge-side end of the rotary body, and a second introducing passage formed in the rotary body and having an end opening to the operating chamber located at the suction-side end of the cylinder and the other end open to the second closed space.

2. A compressor according to claim 1, wherein each of said first and second bearing means has a bearing hole extending in the axial direction of the rotary body, said rotary body includes a first sliding portion formed at its suction-side end and slidably inserted in the bearing hole of the first bearing means, and a second sliding portion formed at the discharge side end of the rotary body and slidably inserted in the bearing hole of the second bearing means, said first closed space is defined in the bearing hole of the first bearing means to face said first sliding portion, and said second closed space is defined in the bearing hole of the second bearing means to face said second sliding portion.

3. A compressor according to claim 1, wherein said casing has an inner face, and said first and second bearing means are fixed to the inner face of the casing.

4. A compressor according to claim 1, wherein said casing has an inner face, and one of said first and second bearing means is fixed to the inner face of the casing and the other bearing means is supported by casing to be movable in the radial direction of the cylinder with respect to the casing.

5. A compressor according to claim 2, wherein said first sliding portion has a first pressure receiving-face exposed to said first closed space, said second sliding portion has a second pressure-receiving face exposed to said second closed space, and the sum of areas of the first and second pressure-receiving faces is substantially equal to the cross-sectional area of an inner hole of the cylinder.

6. A fluid compressor comprising:

a cylinder having a suction-side end and a discharge-side end;

first bearing means for rotatably supporting and air-tightly closing said suction-side end of the cylinder;

second bearing means for rotatably supporting and air-tightly closing said discharge-side end of the cylinder;

a columnar rotary body arranged in the cylinder so as to extend in an axial direction of the cylinder and be eccentric thereto, and rotatable relative to said cylinder in such a manner that part of the rotary body is in contact with the inner circumferential face of the cylinder, said rotary body having a suction-side end rotatably supported by the first bearing means, a discharge-side end rotatably supported by the second bearing means, and a spiral groove formed in the outer circumferential surface of the rotary body, the spiral groove having pitches being narrowed gradually with distance from said suction-side end of the cylinder, said suction-side end having a first pressure-receiving face and said discharge-side end having a second pressure receiving face, and the sum of the areas of the first and second pressure-receiving faces being substantially equal to the cross-sectional area of an inner hole of said cylinder;

a spiral blade fitted in the spiral groove so as to be slidable, substantially in the radial direction of said cylinder, having an outer circumferential surface in close contact with the inner circumferential face of the cylinder, and dividing a space defined between the inner circumferential face and the outer circumferential surface of the rotary body into a plurality of operating chambers;

drive means for relatively rotating the cylinder and the rotary body, thereby introducing a fluid from the suction-side end of said cylinder into the operating chamber at the side of the suction-side end of the rotary body, transferring the fluid toward the discharge-side end of the cylinder through the operating chambers, and discharging the fluid from the discharging-side end of the cylinder to an outlet;

first pressure applying means for applying pressure of the fluid discharged from the discharge-side end of the cylinder to the first pressure-receiving face of the rotary body; and second pressure applying means for applying pressure of the fluid introduced into the suction-side end of the cylinder to the second pressure-receiving face of the rotary body.

7. A compressor according to claim 6, wherein said first pressure-apply means includes a first closed space defined in said first bearing means and facing the suction-side end of the rotary body, and first introducing means for introducing the fluid discharged from the cylinder into the first closed space.

8. A compressor according to claim 7, wherein said second pressure-apply means includes a second closed space defined in the second bearing means and facing the discharge-side of the rotary body, and second introducing means for introducing the fluid introduced into the cylinder into the second space.

9. A compressor according to claim 8, wherein each of said first and second bearing means has a bearing hole extending in the axial direction of the rotary body, said rotary body includes a first sliding portion formed at its suction-side end and slidably inserted in the bearing hole of the first bearing means, and a second sliding portion formed at the discharge-side end of the rotary body and slidably inserted in the bearing hole of the second bearing means, said first closed space is defined in the bearing hole of the first bearing means to face said first sliding portion, and said second closed space is defined in the bearing hole of the second bearing means to face said second sliding portion.

10. A compressor according to claim 9, wherein said first pressure applying means includes a case containing said cylinder, first and second bearing means and the drive means, and a first introducing passage formed in the first bearing means and causing the first closed space to communicate within the casing.

11. A compressor according to claim 9, wherein said second pressure applying means includes a second introducing passage formed in said rotary body and having an end open to the operating chamber located at the suction-side end of the cylinder and the other end open to the second closed space.

12. A compressor according to claim 9, wherein said first pressure-receiving face is formed on said first sliding portion and exposed to said first closed space, and said second pressure-receiving face is formed on said second sliding portion and exposed to said second closed space.

* * * * *